US012559941B2

(12) United States Patent
Repolusk et al.

(10) Patent No.: US 12,559,941 B2
(45) Date of Patent: Feb. 24, 2026

(54) PROFILED METALLIC SHEET FOR A SANDWICH PANEL

(71) Applicant: ArcelorMittal, Luxembourg (LU)

(72) Inventors: René Repolusk, Traun (AT); Semir Mujakic, Traun (AT)

(73) Assignee: ArcelorMittal, Luxembourg (LU)

( * ) Notice: Subject to any disclaimer, the term of this patent is extended or adjusted under 35 U.S.C. 154(b) by 186 days.

(21) Appl. No.: 18/279,602

(22) PCT Filed: Mar. 15, 2021

(86) PCT No.: PCT/IB2021/052117
§ 371 (c)(1),
(2) Date: Sep. 1, 2023

(87) PCT Pub. No.: WO2022/195321
PCT Pub. Date: Sep. 22, 2022

(65) Prior Publication Data
US 2024/0141646 A1 May 2, 2024

(51) Int. Cl.
*E04C 2/292* (2006.01)
*E04C 2/20* (2006.01)

(52) U.S. Cl.
CPC ..... *E04C 2/292* (2013.01); *E04C 2/205* (2013.01)

(58) Field of Classification Search
CPC ..... E04C 2/292; E04C 2/205
See application file for complete search history.

(56) References Cited

U.S. PATENT DOCUMENTS 3,386,218 A * 6/1968 Scott ..... E04B 1/6803 52/794.1
3,797,190 A * 3/1974 Widdowson ..... E04C 2/292 52/592.4
4,186,539 A * 2/1980 Harmon ..... E04B 1/6129 52/580
5,293,728 A * 3/1994 Christopher ..... E04C 2/292 52/590.3
6,718,721 B2 * 4/2004 Albany ..... E04C 2/292 52/794.1
6,834,468 B1 * 12/2004 Kroie ..... E04C 2/292 52/794.1

FOREIGN PATENT DOCUMENTS

FR 2893101 A1 5/2007
WO WO 03/091016 A2 11/2003

* cited by examiner

*Primary Examiner* — Patrick J Maestri
(74) *Attorney, Agent, or Firm* — Davidson Kappel LLC

(57) ABSTRACT

A panel extending along a longitudinal axis (X) and including a profiled metallic tray (15), a profiled metallic sheet (1) and an insulation material (16) sandwiched between the profiled metallic tray (15) and the profiled metallic sheet (1), the profiled metallic sheet (1) including in cross-section perpendicular to the longitudinal axis (X) at least a main part (3) substantially lying down in a plane P and a lateral flange (7) extending inwards from an extremity of the main part (3) and including a U-shaped bend forming a protrusion (8) extending outwards and delimited by two lateral walls (9, 10) and a free end (11), wherein the panel (2) includes a longitudinal seal (12) located in the protrusion (8) away from its free end (11) and compressed between the lateral walls (9, 10) of the protrusion (8), thus delimiting an unfillable volume (V) in the protrusion (8).

10 Claims, 2 Drawing Sheets

PROFILED METALLIC SHEET FOR A SANDWICH PANEL

The present invention relates to a profiled metallic sheet for a sandwich panel, said panels being intended to be assembled together for the construction of building envelopes, and more particularly intended for the construction of building roofs and walls, without being limited thereto. The present invention also relates to the method for the manufacturing of such a profiled metallic sheet.

BACKGROUND

It is known to assemble sandwich panels comprising an insulation layer between an external metallic facing and an internal metallic facing to build walls or roofs.

Moreover, it is known to design the panel with a profiled metallic sheet comprising a long protrusion extending outwards from one of the longitudinal flange of the profiled metallic sheet, the opposite flange of said profiled metallic sheet comprising a step intended to cooperate with the protrusion of the profiled metallic sheet of an adjacent panel. Thanks to this design, the screws used to fasten the panels on the building structure can be hidden behind the protrusion.

It is also known to manufacture the panel by spraying liquid foam between the external and internal metallic facings, said foam thus expanding between them.

SUMMARY OF THE INVENTION

However and because of the thin transverse section of the protrusion, the foam does not correctly expand inside the protrusion. Air pockets can form and, during thermal expansion of the panel, they deform locally the protrusion. Moreover, as the adhesion promoter usually added between the metallic facings and the foam cannot penetrate inside the protrusion, the foam does not correctly adhere to the inside walls of the protrusion. This results in delamination of the foam, and thus deformation of the protrusion unavoidably occurs.

In an attempt to overcome this drawback, it is also known to stick a foam tape of rectangular section on the metallic facing ahead of its profiling so that, after profiling, the foam tape is positioned in the protrusion.

However, as the foam tape only adheres to one internal face of the protrusion, the foam can flow between the foam tape and the other internal face of the protrusion. The drawbacks described above thus also occur in that case.

An aim of the present invention is therefore to remedy the drawbacks of the prior art by providing a profiled metallic sheet and a panel which prevents the deformations of the protrusion.

For this purpose, a first subject of the present invention consists of a panel extending along a longitudinal axis (X) and comprising a profiled metallic tray (15), a profiled metallic sheet (1) and an insulation material (16) sandwiched between the profiled metallic tray (15) and the profiled metallic sheet (1), wherein said profiled metallic sheet (1) comprises in cross-section perpendicular to the longitudinal axis (X) at least:

- a main part (3) substantially lying down in a plane P,
- a first lateral flange (4) extending inwards from a first extremity of the main part (3) and comprising a step (6) extending inwards,
- a second lateral flange (7) extending inwards from an opposite extremity of the main part (3) and comprising a U-shaped bend forming a protrusion (8) extending outwards and delimited by two lateral walls (9, 10) and a free end (11), said free end (11) being able to fit with the step (6) of the first lateral flange (4) of another adjacent panel, wherein the panel (2) comprises a longitudinal seal (12) located in the protrusion (8) away from its free end (11) and compressed between the lateral walls (9, 10) of the protrusion (8), thus delimiting an unfillable volume (V) in said protrusion.

The panel according to the invention may also have the optional features listed below, considered individually or in combination:

- The longitudinal seal (12) is located all along the protrusion;
- The longitudinal seal (12) is cylindrical;
- The first lateral flange (4) comprises a U-shaped bend forming a lateral tenon (13) extending in parallel to plane P and outwards, and the second lateral flange (7) comprises a U-shaped bend forming a lateral mortise (14) extending in parallel to plane P and inwards, the lateral tenon (13) and the lateral mortise (14) being complementary in shape;
- The second lateral flange (7) comprises an inclined wall (28) linking the lateral mortise (14) and the protrusion (8), and wherein the seal is located in the protrusion (8) at the junction between said protrusion (8) and said inclined wall;
- The lateral walls (9, 10) of the protrusion (8) extend in parallel to the plane P;
- the profiled metallic tray (15) comprises in cross-section perpendicular to the longitudinal axis (X) at least:
  - a main part (17) extending in parallel to the plane P,
  - a first lateral flange (18) extending inwards from a first extremity of the main part (17) and comprising a U-shaped bend forming a second lateral tenon (20) extending in parallel to plane P and outwards, and
  - a second lateral flange (19) extending inwards from an opposite extremity of the main part (17) and comprising a U-shaped bend forming a second lateral mortise (21) extending in parallel to plane P and inwards, the second lateral tenon (20) and the second lateral mortise (21) being complementary in shape.

A second subject of the invention consists of a process for the manufacturing of a profiled metallic sheet (1) for a panel comprising at least the following steps:

(i) profiling a metallic strip (29) along a longitudinal axis (X) so that it comprises in cross-section perpendicular to the longitudinal axis (X) at least:
- a main part (3) substantially lying down in a plane P,
- a first lateral flange (4) located at a first extremity of the main part,
- a second lateral flange (7) located at an opposite extremity of the main part (3) and comprising a U-shaped bend forming a protrusion (8) extending outwards and delimited by two lateral walls (9, 10), an opening and a free end, (ii) providing a longitudinal seal (12) in front of the opening of the protrusion (8) opposite to its free end, (iii) inserting the seal (12) in the opening of the protrusion (8) so that said seal (12) is compressed between the lateral walls (9, 10) of the protrusion (8), thus delimiting an unfillable volume (V) in said protrusion (8), and, (iv) cutting to desired length the profiled metallic strip (29) in a direction perpendicular to the longitudinal axis (X) in order to form the profiled metallic sheet.

A third subject of the invention consists of a process for the manufacturing of a panel comprising at least the following steps:

(i) profiling a first metallic strip (29) along a longitudinal axis (X) so that it comprises in cross-section perpendicular to the longitudinal axis (X) at least:
  a main part (3) substantially lying down in a plane P,
  a first lateral flange (4) located at a first extremity of the main part (3), and,
  a second lateral flange (7) located at an opposite extremity of the main part (3) and comprising a U-shaped bend forming a protrusion (8) extending outwards and delimited by two lateral walls (9, 10), an opening and a free end, (ii) Simultaneously profiling a second metallic strip along the longitudinal axis (X) so that it comprises in cross-section perpendicular to the longitudinal axis (X) at least:
  a main part (17) extending in parallel to plane P,
  a first lateral flange (18) extending inwards from a first extremity of the main part (17), and
  a second lateral flange (19) extending inwards from an opposite extremity of the main part, (iii) providing a longitudinal seal (12) in front of the opening of the protrusion (8) opposite to its free end, (iv) inserting the seal (12) in the opening of the protrusion (8) so that said seal (12) is compressed between the lateral walls (9, 10) of the protrusion (8), thus delimiting an unfillable volume (V) in said protrusion (8), (v) Applying a foaming mixture on either the profiled first metallic strip (29) or the profiled second metallic strip, (vi) Foaming the foaming mixture between the profiled first metallic strip (29) and the profiled second metallic strip to form an insulation material (16), and (vii) cutting to desired length the assembly of the profiled metallic strip (29), the profiled second metallic strip and the insulation material (16) to form the panel.

BRIEF DESCRIPTION OF THE DRAWINGS

Other characteristics and advantages of the invention will be described in greater detail in the following description.

The invention will be better understood by reading the following description, which is provided purely for purposes of explanation and is in no way intended to be restrictive, with reference to.

DETAILED DESCRIPTION

It should be noted that the terms "inward", "inwards", "outward" and "outwards" as used in this application refer to the positions and orientations of the different constituent elements of the panel in relation to the position of the insulation material. Consequently, if an element extends inwards, it extends in the direction of the insulation panel. Similarly, if the element extends outwards, it extends in the opposite direction of the insulation panel.

It should also be noted that, to ease the description, the panels will be described in relation to their usual position on a building. Consequently, the terms "inner" and "outer" as used in this application refer to this usual position. Accordingly, the outer metallic sheet is facing the outside and the inner metallic tray is facing the inside of the building. Consequently, the inner flange refers to the flange of the inner tray and the outer flange refers to the flange of the outer sheet. Nevertheless, the panels and the corresponding assembly can be positioned upside down on a building, i.e. with the outer sheet facing the inside of the building.

It should be noted that the terms "lower", "above", "lowest" . . . as used in this application refer to the positions and orientations of the different constituent elements of the panel when the latter is lying on an horizontal plane.

Throughout the text, a sheet is understood to mean an element that has a flat shape, i.e., its thickness is low compared to its other dimensions. Generally speaking, its thickness is 500 to 4000 times lower than its width. The sheet may be made of a single material or a composite assembly. In the latter case, the sheet is a stack of a plurality of layers of the same material or different materials. The material in question may be, among others, a metallic material or a polymer. Steel, aluminum, copper and zinc may be cited as non-restricting examples of metallic materials. The sheet is preferably a metallic sheet. It is preferably made of previously galvanized and pre-coated steel to protect it against corrosion. The inner metallic tray and the outer metallic sheet are examples of sheets.

Within the framework of the invention, the sheet will preferably have been previously formed with the aid of any known forming method, including, by way of non-restricting examples, bending, forming, stamping and molding. In particular, the U-shaped bend described later on is an element of the panel whose manufacturing process is not limited to bending.

Figure 1:
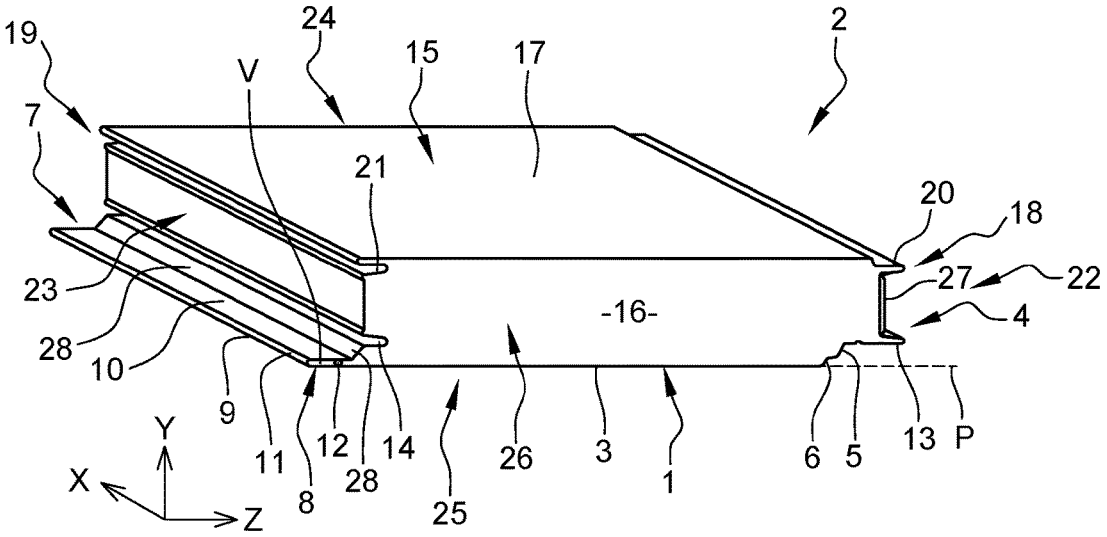
FIG. 1, which represents a perspective view of the panel of the invention.
Figure 2:
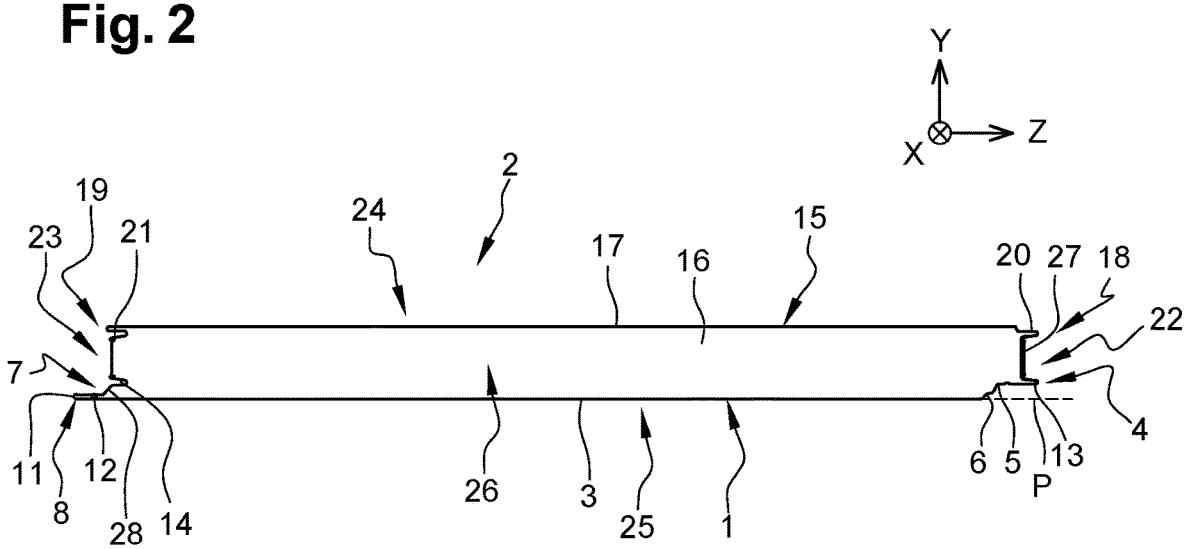
FIG. 2, which represents a cross-section view of the panel of FIG. 1.
Figure 3:
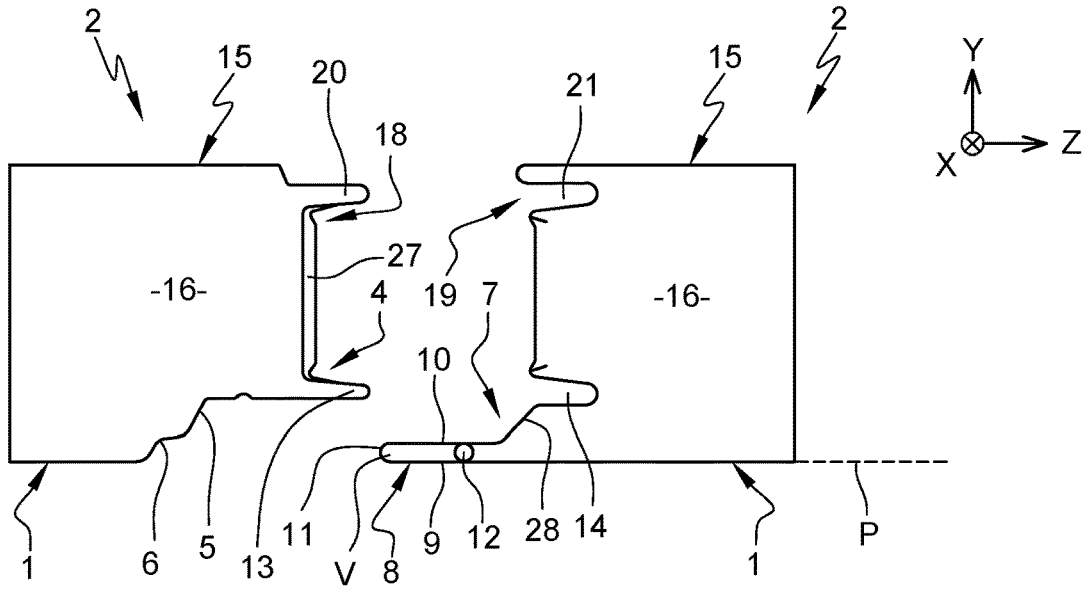
FIG. 3, which represents a detailed cross-section view of the two corresponding flanges of the panel of the invention.

With reference to FIGS. 1 to 3, the panel 2 of the invention has a global parallelepiped rectangular shape and extends along a longitudinal axis X. The panel 2 comprises four lateral sides: two opposite longitudinal sides 22, 23 and two opposite transversal sides 26 extending perpendicularly to the axis X. The panel 2 comprises an inner face 24 intended for facing a building structure (not depicted), and an opposite outer face 25.

The panel 2 further comprises an insulation material 16 sandwiched between a profiled metallic tray 15 that will be further called inner metallic tray since it forms a part of the inner face 24 of the panel 2 and a profiled metallic sheet 1 that will be further called outer metallic sheet since it forms a part of the outer face 25 of the panel 2. The sides of the insulation material 16 thus form the longitudinal lateral edges 22, 23 of the panel 2. As it will be described later, the insulation material 16 is made of expanded foam, for example polyurethane foam.

The inner metallic tray 15 and the outer metallic sheet 1 are largely substantially flat. The substantially flat portion of the outer metallic sheet 1 lie in the plane P while the substantially flat portion of the inner metallic tray 15 is parallel to plane P. Flanges 4, 7, 18, 19 extend from each of the lateral extremities of the flat portions along the longitudinal sides 22, 23 of the insulation material 16. The flanges 4, 7, 18, 19 thus cover partially the sides 22, 23. The uncovered part of each longitudinal side 22, 23 is preferably perpendicular to plane P to ease the interlocking of panels 2. Those two longitudinal sides of the insulation material 16 are further called first 22 and second 23 longitudinal sides.

The inner metallic tray 15 is a metallic sheet of rectangular shape, comprising longitudinal edges and transversal edges, which has been formed at a previous stage. It comprises, in cross-section perpendicular to its longitudinal axis X, a main part further called inner central part 17 and two lateral flanges further called first and second inner flanges 18, 19 and extending inwards from each extremity of the inner central part 17. The inner central part 17 substantially lies down flat in a plane parallel to plane P. According to a variant of the invention, the inner central part 17 comprises stiffeners extending longitudinally to increase the stiffness of the metallic sheet.

The first inner flange 18 extends inwards from a first lateral extremity of the inner central part 17, along the first longitudinal side 22 of the insulation material 16 and comprises a U-shaped bend forming an inner tenon 20 extending in parallel to the inner central part 17, i.e. parallel to plane P, and outwards. In particular, the first inner flange 18 comprises a first inner section substantially perpendicular to the inner central part 17, extending between the first lateral extremity of the inner central part 17 and the inner tenon 20.

In particular, the inner tenon 20 comprises two parallel branches linked by a U-turn. More preferably, the two parallel branches have substantially the same length.

The second inner flange 19 extends inwards from the second lateral extremity of the inner central part 17, along the second longitudinal side 23 of the insulation material 16 and comprises a U-shaped bend forming an inner mortise 21 extending in parallel to the central part 17, i.e. parallel to plane P, and inwards. In particular, the second inner flange 19 comprises a second inner section substantially perpendicular to the inner central part 17, extending between the second lateral extremity of the inner central part 17 and the inner mortise 21.

The inner tenon 20 and inner mortise 21 have shapes that allow their interlocking when one panel 2 is assembled with an adjacent panel 2. Preferably, their shapes are substantially complementary and their dimensions are such that:

- The width of the inner mortise 21 (measured along the Y axis) is substantially equal to the width of the inner tenon 20,
- The length of the inner mortise 21 (measured along the Z axis, starting from the uncovered part of the second longitudinal side 23 of the insulation material 16) is superior or substantially equal to the length of the inner tenon 20 (measured along the Z axis, starting from the uncovered part of the first longitudinal side 22 of the insulation material 16),
- The position of the inner mortise 21 (i.e. the distance measured along the Y axis between the lowest portion of the inner mortise 21 and plane P) is substantially equal to the position of the inner tenon 20 (i.e. the distance measured along the Y axis between the lowest portion of the inner tenon 20 and plane P).

Preferably, the shape and dimensions of the inner tenon 20 are such that it perfectly fits into the inner mortise 21. By "perfectly fits" it is meant that the inner tenon 20 and the inner mortise 21 are substantially in contact to one another except in areas where a gasket is added for sealing purposes, such as airtightness or thermal insulation. In particular, the inner mortise 21 comprises two parallel branches linked by a U-turn. More preferably, the two parallel branches have substantially the same length. The internal distance between the two parallel branches is substantially equal to the external distance between the two parallel branches of the inner tenon 20. The U-turn of the inner tenon 20 and the U-turn of the inner mortise 21 are preferably separated by a gap allowing the insertion of a gasket, positioned in the U-turn of the inner mortise 21 before assembling of the panels 2. The gasket can be, among others, of an elastomeric material which is preferably shaped to substantially conform to the shape of the inner mortise 21 on assembly, PVC foam, PU foam, PVC hollow section joint or of an intumescent material, such as a mineral fibre based mat incorporating phosphate or exfoliating graphite. In addition a gasket 27 is also added at least against the lateral edge 22 of the panel 2 for sealing purposes.

The outer metallic sheet 1 is a metallic sheet of rectangular shape, comprising longitudinal edges and transversal edges, which has been formed at a previous stage. It comprises, in cross-section perpendicular to its longitudinal axis X, a main part further called outer central part 3 and two lateral flanges further called outer flanges 4, 7 and extending inwards from each extremity of the outer central part 3. Preferably, most of the outer central part 3 is lying down in plane P.

The first outer flange 4 extends inwards from a first extremity of the outer central part 3, along the first longitudinal side 22 of the insulation material 16 and comprises a U-shaped bend forming an outer tenon 13 extending outwards and in parallel to the inner tenon 20. This outer tenon 13 is on the same side of the panel 2 than the inner tenon 20.

The outer tenon 13 is linked to the outer central 3 part by a S-shaped bend 5 followed by a step 6. The functions of these S-shaped bend 5 and step 6 are detailed further in the description. In another embodiment not depicted, the outer tenon 13 is linked to the outer central 3 part only by the step 6.

The outer tenon 13 comprises two parallel branches linked by a U-turn. More preferably, the two parallel branches have substantially the same length.

The outer tenon 13 and the inner tenon 20 are aligned one above the other. In other words, the base of the outer tenon 13 and the base of the inner tenon 20 are in the same vertical plane, perpendicular to plane P. More preferably, the base of one parallel branch of the outer tenon 13 and the base of one parallel branch of the inner tenon 20 are in the same vertical plane, perpendicular to plane P. More preferably, the vertical plane in question is the plane of the uncovered part of the first longitudinal side 22 of the insulation material 16.

The second outer flange 7 extends inwards from a second extremity of the outer central part 3, along the second longitudinal side 23 of the insulation material 16 and comprises a U-shaped bend forming an outer mortise 14 extending inwards and in parallel to the inner mortise 21. This outer mortise 14 is on the same side of the panel 2 than the inner mortise 21. In particular, the outer mortise 14 is linked to the outer central part 3 by a protrusion 8 which is in the form of an external male projecting form comprising two opposite lateral walls 9, 10 parallel to plane P and a free end 11 that protrudes from the corresponding longitudinal edge of the outer metallic sheet 1 in order to be received in the step 6 linked to the outer tenon 13 of the adjacent panel 2.

In addition, the second outer flange 7 comprises an inclined wall 28 linking the outer mortise 14 and the wall 10 of the protrusion 8. The protrusion 8 is closed on one end by the free end 11 and is open on the other end to the area located between the inner central part 17 and the outer central part 3. The corresponding opening is located at the junction between the lateral wall 10 and the inclined wall 28.

When a first panel 2 and a second adjacent panel 2 are assembled together, the free end 11 of the protrusion 8 of the first panel 2 is received in the step 6 of the second panel 2. Once the second panel 2 is fastened to a building structure with a fastener, for example a screw, inserted through said panel 2 perpendicularly to the outer metallic sheet 1 through the S-shaped bend 5 of the second panel 2, the protrusion 8 of the first panel received in the step 6 of the second panel 2 hides the head of the fastener. In addition, a free space is thus formed and delimited by the lateral wall 10 of the protrusion 8 and the wall of the S-shaped bend 5 (or of the step 6) of the other panel 2 that can be filled with an additional insulation element.

The outer tenon 13 and outer mortise 14 have shapes that allow their interlocking when one panel 2 is assembled with an adjacent panel 2. Preferably, their shapes are substantially complementary and their dimensions are such that:

- The width of the outer mortise 14 (measured along the Y axis) is substantially equal to the width of the outer tenon 13,
- The length of the outer mortise 14 (measured along the Z axis, starting from the uncovered part of the second longitudinal side 23 of the insulation material 16) is superior or substantially equal to the length of the outer tenon 13 (measured along the Z axis, starting from the uncovered part of the first longitudinal side 22 of the insulation material 16),
- The position of the outer mortise 14 (i.e. the distance measured along the Y axis between the lowest portion of the outer mortise 14 and plane P) is substantially equal to the position of the outer tenon 13 (i.e. the distance measured along the Y axis between the lowest portion of the outer tenon 13 and plane P).

Preferably, the shape and dimensions of the outer tenon 13 are such that it perfectly fits into the outer mortise 14. By "perfectly fits" it is meant that the outer tenon 13 and the outer mortise 14 are substantially in contact to one another except in areas where a gasket has been added for sealing purposes, such as airtightness or thermal insulation. In particular, the outer mortise 14 comprises two parallel branches linked by a U-turn. More preferably, the two parallel branches have substantially the same length. The internal distance between the two parallel branches is substantially equal to the external distance between the two parallel branches of the outer tenon 13. The U-turn of the outer tenon 13 and the U-turn of the outer mortise 14 are preferably separated by a gap allowing the insertion of a gasket, positioned in the U-turn of the outer mortise 14 before assembling of the panels 2. The gasket can be, among others, of an elastomeric material which is preferably shaped to substantially conform to the shape of the outer mortise 14 on assembly, PVC foam, PU foam, PVC hollow section joint or of an intumescent material, such as a mineral fibre based mat incorporating phosphate or exfoliating graphite.

Preferably, the outer mortise 14 and the inner mortise 21 are aligned one above the other. In other words, the start of the outer mortise 14 and the start of the inner mortise 21 are in the same vertical plane, perpendicular to plane P. More preferably, the start of one parallel branch of the outer mortise 14 and the start of one parallel branch of the inner mortise 21 are in the same vertical plane, perpendicular to plane P. More preferably, the vertical plane in question is the plane of the uncovered part of the second longitudinal side 23 of the insulation material 16.

Both lengths of the outer mortise 14 and the inner mortise 21 can be such that a fastener can be inserted from the outer metallic sheet 1 perpendicularly into the inner mortise 21 and into the outer mortise 14. In other words, the inner 21 and outer 14 mortises are longer than the width of the fastener. In a preferred embodiment, the inner 21 and outer 14 mortises have the same length.

According to the invention, the panel 2 comprises a longitudinal cylindrical seal located in and all along the protrusion 8 away from its free end 11, and compressed between the lateral walls 9, 10 of said protrusion 8. By "away from the free end", it must be understood that the seal 12 is not in contact with the U-turn wall forming the free end 11 of the protrusion 8. The seal 12 thus delimits an unfillable volume V in the protrusion 8 as illustrated on FIG. 3. In other words, the foam forming the insulation material 16 cannot reach and expand inside the volume V of the protrusion 8 while the panel 2 is filled with said foam. Consequently, air pockets and/or partial foaming of the protrusion are prevented. Local deformations of the protrusion are thus prevented.

As an example and in a non-limitative manner, the seal 12 is located at the opening of the protrusion 8, meaning at the junction between the inclined wall 28 and the considered lateral wall 10 of the protrusion. The seal 12 may also be located equidistantly between the opening and the free end 11 of the protrusion 8 or may also be located closer to the opening of the protrusion 8 than its free end 11, for example in the first third of said protrusion 8. Locating the seal 12 close to the opening or at the opening prevents the foam from entering most of the protrusion, which further improves the quality and ageing of the protrusion.

Advantageously, the seal 12 is made of a deformable material, for example rubber or any other polymeric material with similar mechanical properties than rubber.

Preferably, the seal 12 is cylindrical, i.e. has a round section. This makes its insertion easier since it doesn't have to be oriented.

Advantageously, the seal 12 is compressed in the protrusion to further prevent the foam from entering the protrusion. The ratio between the internal width of the protrusion and the diameter of the seal is preferably lower than 0.8, more preferably comprised between 0.3 and 0.8.

Figure 4:
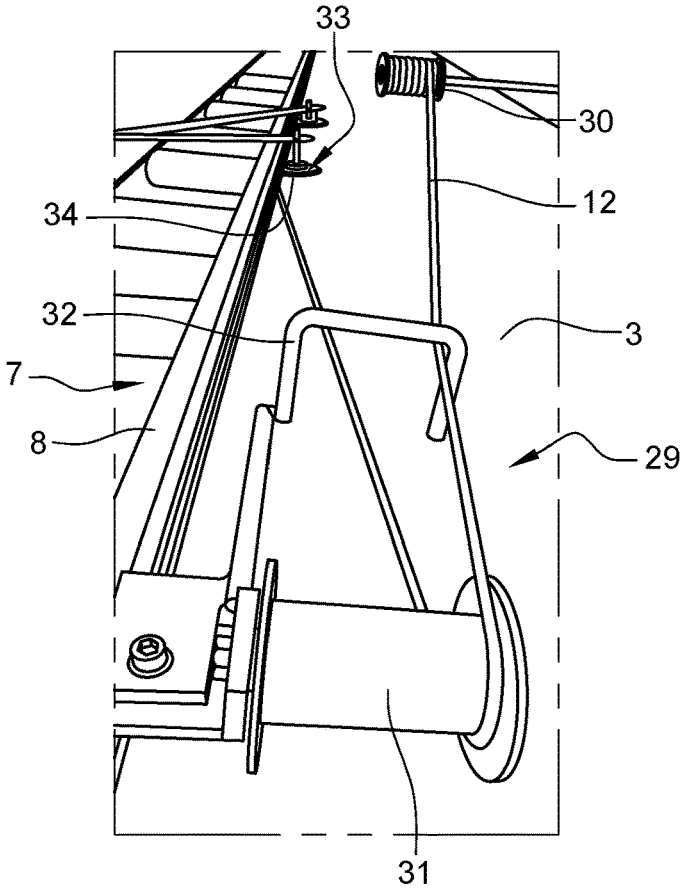
FIG. 4, which represents a perspective view of a part of the elements for implementing the process of the invention.

Regarding FIG. 4, a process for the manufacturing of the panel 2 of the invention will now be described.

In a first step, a first metallic strip and a second metallic strip are simultaneously profiled so that the first strip 29 has the profile of the outer metallic sheet 1 and the second strip has the profile of the inner metallic tray 15 each comprising a main part 3, respectively 17, a first lateral flange 4, respectively 18 and a second lateral flange 7, respectively 19 as described above.

The first step is operated with 2 rollforming lines, where a metallic coil is uncoiled at one extremity and goes through a series of rolls to obtain the desired profile.

In the second step, a longitudinal seal 12 is provided in front of the opening of the protrusion 8 opposite to its free end 11. The step of providing the seal 12 is carried out by continuously unwinding the longitudinal seal 12 from a coil 30 installed above the profiled metallic strip 29. The unwounded seal 12 thus turn round by being redirected on a redirection roll 31 which is free in rotation, in order to be positioned in front of the opening of the protrusion 8. A U-shaped spacer 32 helps to redirect the seal 12 into the correct position for the redirection roll. The respective centers of the coil 30 and of the roll 31 are stationary comparatively to the running profiled metallic strip 29.

In the third step, the seal 12 is inserted in the opening of the protrusion 8, thus delimiting the unfillable volume V in said protrusion 8. The insertion of the seal 12 is achieved with a disc 33 disposed parallel to and above the inner face of the profile metallic strip 29. Preferably the disc thickness is adjusted to the internal width of the protrusion, i.e. its thickness corresponds to the distance between the respective inner faces of the lateral walls 9, 10 of the protrusion 8. More precisely the center of the disc 33 is stationary, and the circular edge 34 of the disc 33 pushes the seal 12 inside the protrusion 8 while the profiled metallic strip 29 is running. The position of the disc 33 along the Z axis of the metallic strip is adjusted so that the seal is inserted in the protrusion at the desired position as described above.

In a fourth step, a foaming mixture is applied with a dedicated applicator on the inner side of either the profiled first metallic strip 29 or the profiled second metallic strip. Then the mixture foams between the profiled first metallic strip 29 and the profiled second metallic strip to form the insulation material 16 while the two strips are transported by a twin-belt conveyer and maintained at a given distance. Thanks to the seal 12, no foam mixture is applied nor expands inside the unfillable volume V of the protrusion 8.

Finally in a fifth step, the assembly of the profiled first metallic strip 29, the profiled second metallic strip and the insulation material 16 is cut at the desired length in order to form one or several panels 2 of the invention.

What is claimed is:

1. A panel extending along a longitudinal axis and comprising:

a profiled metallic tray;

a profiled metallic sheet; and an insulation material sandwiched between the profiled metallic tray and the profiled metallic sheet, the profiled metallic sheet including in cross-section perpendicular to the longitudinal axis:

a main part defining a main plane, a first lateral flange extending inwards from a first extremity of the main part and including a step extending inwards, a second lateral flange extending inwards from an opposite extremity of the main part and including a U-shaped bend forming a protrusion extending outwards and delimited by two lateral walls and a free end, the free end fittable with a further step of a further first lateral flange of another adjacent panel; and a longitudinal seal located in the protrusion away from the free end and compressed between the two lateral walls to delimit an unfillable volume in the protrusion;

the longitudinal seal being cylindrical.

2. The panel as recited in claim 1 wherein the longitudinal seal is located an entire longitudinal extent of the protrusion.

3. The panel as recited in claim 1 wherein:

the first lateral flange includes a U-shaped bend forming a lateral tenon extending in parallel to the main plane and outwards, the second lateral flange includes a further U-shaped bend forming a lateral mortise extending in parallel to the main plane and inwards, the lateral tenon and the lateral mortise being complementary in shape.

4. The panel as recited in claim 3 wherein the second lateral flange includes an inclined wall linking the lateral mortise and the protrusion, and wherein the seal is located in the protrusion at the junction between the protrusion and the inclined wall.

5. The panel as recited in claim 1 wherein the two lateral walls of the protrusion extend in parallel to the main plane.

6. The panel as recited in claim 1 wherein the profiled metallic tray includes in cross-section perpendicular to the longitudinal axis at least:

a tray main part extending in parallel to the main plane, a tray first lateral flange extending inwards from a first extremity of the tray main part and including a U-shaped bend forming a tray second lateral tenon extending in parallel to the main plane P and outwards, and a tray second lateral flange extending inwards from an opposite extremity of the tray main part and including a U-shaped bend forming a tray second lateral mortise extending in parallel to the main plane and inwards, the tray second lateral tenon and the tray second lateral mortise being complementary in shape.

7. A process for the manufacturing of a profiled metallic sheet for a panel, the process comprising the following steps:

profiling a metallic strip along a longitudinal axis so that the metallic strip includes in cross-section perpendicular to the longitudinal axis at least:

a main part defining a main plane, a first lateral flange located at a first extremity of the main part, a second lateral flange located at an opposite extremity of the main part and including a U-shaped bend forming a protrusion extending outwards and delimited by two lateral walls, an opening and a free end, providing a longitudinal seal in front of the opening of the protrusion opposite to the free end;

inserting the seal in the opening of the protrusion so that the seal is compressed between the two lateral walls of the protrusion to delimit an unfillable volume in the protrusion; and cutting to desired length the profiled metallic strip in a direction perpendicular to the longitudinal axis in order to form the profiled metallic sheet;

the longitudinal seal being cylindrical.

8. A process for the manufacturing of the panel according to claim 1, the process comprising the following steps:

profiling a first metallic strip along a longitudinal axis so that the first metallic strip includes in cross-section perpendicular to the longitudinal axis at least:

the main part defining the main plane, the first lateral flange located at the first extremity of the main part, and the second lateral flange located at the opposite extremity of the main part and in including the U-shaped bend forming the protrusion extending outwards and delimited by the two lateral walls, an opening and the free end;

simultaneously profiling a second metallic strip along the longitudinal axis so that the second metallic strip includes in cross-section perpendicular to the longitudinal axis at least:

a second main part extending in parallel to the main plane, a second first lateral flange extending inwards from a second first extremity of the second main part, and a second second lateral flange extending inwards from an opposite extremity of the second main part;

providing a longitudinal seal in front of the opening of the protrusion opposite to the free end;

inserting the seal in the opening of the protrusion so that the seal is compressed between the two lateral walls of the protrusion to delimit an unfillable volume in the protrusion;

applying a foaming mixture on either the profiled first metallic strip or the profiled second metallic strip;

foaming the foaming mixture between the profiled first metallic strip and the profiled second metallic strip to form the insulation material; and cutting to desired length an assembly of the profiled first metallic strip, the profiled second metallic strip and the insulation material to form the panel.

9. A panel extending along a longitudinal axis and comprising:

a profiled metallic tray;

a profiled metallic sheet; and an insulation material sandwiched between the profiled metallic tray and the profiled metallic sheet, the profiled metallic sheet including in cross-section perpendicular to the longitudinal axis:

a main part defining a main plane, a first lateral flange extending inwards from a first extremity of the main part and including a step extending inwards, a second lateral flange extending inwards from an opposite extremity of the main part and including a U-shaped bend forming a protrusion extending outwards and delimited by two lateral walls and a free end, the free end fittable with a further step of a further first lateral flange of another adjacent panel; and a longitudinal seal located in the protrusion away from the free end and compressed between the two lateral walls to delimit an unfillable volume in the protrusion;

the first lateral flange including a U-shaped bend forming a lateral tenon extending in parallel to the main plane and outwards, the second lateral flange including a further U-shaped bend forming a lateral mortise extending in parallel to the main plane and inwards, the lateral tenon and the lateral mortise being complementary in shape.

10. A panel extending along a longitudinal axis and comprising:

a profiled metallic tray;

a profiled metallic sheet; and an insulation material sandwiched between the profiled metallic tray and the profiled metallic sheet, the profiled metallic sheet including in cross-section perpendicular to the longitudinal axis:

a main part defining a main plane, a first lateral flange extending inwards from a first extremity of the main part and including a step extending inwards, a second lateral flange extending inwards from an opposite extremity of the main part and including a U-shaped bend forming a protrusion extending outwards and delimited by two lateral walls and a free end, the free end fittable with a further step of a further first lateral flange of another adjacent panel; and a longitudinal seal located in the protrusion away from the free end and compressed between the two lateral walls to delimit an unfillable volume in the protrusion;

the profiled metallic tray including in cross-section perpendicular to the longitudinal axis at least:

a tray main part extending in parallel to the main plane, a tray first lateral flange extending inwards from a first extremity of the tray main part and including a U-shaped bend forming a tray second lateral tenon extending in parallel to the main plane P and outwards, and a tray second lateral flange extending inwards from an opposite extremity of the tray main part and including a U-shaped bend forming a tray second lateral mortise extending in parallel to the main plane and inwards, the tray second lateral tenon and the tray second lateral mortise being complementary in shape.

* * * * *